US007980774B2

(12) United States Patent
Nakamaki et al.

(10) Patent No.: US 7,980,774 B2
(45) Date of Patent: Jul. 19, 2011

(54) RECORDING APPARATUS INCLUDING TEMPERATURE DETECTOR

(75) Inventors: Motohiro Nakamaki, Azumino (JP); Mamoru Wada, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 12/689,682

(22) Filed: Jan. 19, 2010

(65) Prior Publication Data

US 2010/0119279 A1 May 13, 2010

Related U.S. Application Data

(63) Continuation of application No. 11/790,353, filed on Apr. 25, 2007, now Pat. No. 7,665,919.

(30) Foreign Application Priority Data

Apr. 28, 2006 (JP) ..... P2006-124643

(51) Int. Cl.
*B41J 2/30* (2006.01)

(52) U.S. Cl. ..... 400/124.03; 400/124.13; 101/93.05

(58) Field of Classification Search ..... 400/124.01, 400/124.03, 124.13; 101/93.05
See application file for complete search history.

(56) References Cited

U.S. PATENT DOCUMENTS 5,720,561 A 2/1998 Ryan et al.

FOREIGN PATENT DOCUMENTS

| | | |
|---|---|---|
| JP | 04-097858 | 3/1992 |
| JP | 05-116347 | 5/1993 |
| JP | 05-185615 | 7/1993 |
| JP | 06-024018 | 2/1994 |
| JP | 06-166189 | 6/1994 |
| JP | 08-020121 | 1/1996 |

*Primary Examiner* — Leslie J Evanisko
(74) *Attorney, Agent, or Firm* — Nixon & Vanderhye P.C.

(57) ABSTRACT

A recording control device includes a head driving circuit, a temperature detector, and a controller. The head driving circuit includes a power supply that supplies a driving current to a plurality of driving coils used for driving a plurality of recording wires provided in a recording head. An induced current flows through a circuit which is connected to the plurality of driving coils when the driving current to the driving coils stops. The temperature detector detects a temperature of heat generated in the circuit due to the induced current, and the controller controls an operation of the recording head based on the temperature detected by the temperature detector.

5 Claims, 5 Drawing Sheets

RECORDING APPARATUS INCLUDING TEMPERATURE DETECTOR

CROSS-REFERENCES TO RELATED APPLICATIONS

This application is a continuation of U.S. patent application Ser. No. 11/790,353, filed Apr. 25, 2007, now U.S. Pat. No. 7,665,919, patented Feb. 23, 2010, which claims the benefit of Japanese Patent Application No. 2006-124643, filed Apr. 28, 2006, the entire contents of each of which are hereby incorporated by reference in this application.

BACKGROUND

1. Technical Field

The present invention relates to a recording control device for controlling an operation of a recording head and a recording apparatus having the recording control device.

2. Related Art

There is known a dot impact printer having a head protection circuit that detects the temperature of a recording head to protect the recording head from being overheated. The temperature of the recording head is detected by, for example, a temperature detection sensor provided near or inside the recording head, particularly a temperature detection sensor provided near a driving coil (see for example, JP-A-H05-185615, Patent Document 1).

However, in the case of the dot impact printer that performs recording by driving a plurality of driving coils so as to cause recording wires to be projected, it is not easy to accurately detect the temperature rise in all of the driving coils. That is, it is very difficult to provide a sensor on each of the driving coils since the inner space of the recording head is limited and it increases manufacturing costs.

In addition, when a fewer number of sensors than driving coils are provided near predetermined driving coils, distances between the driving coils and the sensors are not constant, and it is difficult to accurately detect the temperature of each of the driving coils. For this reason, a threshold temperature at which a protection operation is triggered needs to be set with a great margin with respect to an operation limit temperature.

SUMMARY

An advantage of some aspects of the invention is to provide a recording control device that controls an operation of a recording head having recording wires and a recording apparatus that records an image using the recording wires, which are capable of accurately and effectively performing protection against heating due to driving of the driving coil and reliably preventing being overheated.

The advantage can be attained by at least one of the following aspects:

A first exemplary aspect of the invention provides a recording control device including: a head driving circuit having a power supply that supplies a driving current to a plurality of driving coils, the driving coils driving a plurality of recording wires provided in a recording head, wherein an induced current flows through a circuit which is connected to the plurality of driving coils when the driving current to the driving coils stops; a temperature detector that detects a temperature of heat generated in the circuit due to the induced current; and a controller that controls an operation of the recording head based on the temperature detected by the temperature detector.

In the configuration described above, since the temperature of the circuit connected to the driving coils used for driving the recording wires is detected, and the operation of the recording head is controlled based on the temperature, it is possible to reliably prevent the driving coils and circuits from being overheated when the driving coils are electrically conducted. As a result, it is possible to realize a stable operation of the printer over a long period of time and to improve reliability.

In this case, since the induced current flows to the circuit connected to the driving coils, when the driving current to the driving coils stops, the temperature of the circuit accurately reflects the overall conduction state of the driving coils. Accordingly, it is not necessary to provide a sensor corresponding to each of the driving coils, and it is possible to detect the temperature, which accurately reflects the conduction state of the driving coils, by means of a small number of temperature detectors. As a result, it is possible to accurately perform protection control based on the temperature.

In the recording control device described above, preferably, the temperature detector is provided adjacent to an element on the circuit of the head driving circuit and detects the temperature of the element. In this case, by detecting the temperature of the element that emits heat due to the induced current of the driving coil, it is possible to accurately detect the temperature that accurately reflects the conduction state of each of the driving coils.

Further, in the recording control device described above, preferably, the circuit is a circulation circuit that causes the induced current to be circulated to the power supply and the temperature detector detects the temperature of the circulation circuit. In addition, preferably, the circulation circuit includes a constant voltage circuit that causes the induced current to stop at a predetermined voltage or less, and the temperature detector detects the temperature of the constant voltage circuit. It is possible to make a fast response of the recording head and to appropriately detect the temperature.

Furthermore, in the recording control device described above, preferably, the temperature detector is provided on a substrate separately from the recording head. Accordingly, the cost of the recording head does not increase, and the space of the temperature detector is not limited.

Furthermore, in the recording control device described above, it is preferable to include a switch that switches between supplying driving power to the driving coils and stopping the supplying in accordance with a pulse input having a predetermined width (conduction time of the driving coil). In addition, preferably, the controller changes the width of the pulse input to the switch based on the temperature detected by the temperature detector. In this case, since the conduction time of the driving coil can be changed based on the temperature detected by the temperature detector, it is possible to reliably prevent the driving coil or various circuits from being overheated. For example, when the detected temperature rises, the conduction time of the driving coil is shortened. When the temperature lowers, the conduction time of the driving coil can return to the original state.

Furthermore, in the recording control device described above, it is preferable to include a switch that switches between supplying driving power to the driving coils and stopping the supplying in accordance with a pulse input having a predetermined width. In addition, preferably, the controller changes an interval between the pulses based on the temperature detected by the temperature detector. In addition, the operation speed of a carriage on which the recording head is mounted may be changed corresponding to the pulse interval. Since the conduction time per unit time of the driving coil is shortened, it is possible to reliably prevent the driving coil or various circuits from being overheated. Furthermore, an efficient print speed can be set.

In a second aspect of the invention, a recording apparatus includes a recording head that has a plurality of recording wires and a plurality of driving coils used for driving the plurality of recording wires, and a recording control device. The recording control device includes: a head driving circuit having a power supply that supplies a driving current to the plurality of driving coils, wherein an induced current flows through a circuit which is connected to the plurality of driving coils when supplying of the driving current to the driving coils stops; a temperature detector that detects a temperature of heat generated in the circuit due to the induced current; and a controller that controls an operation state of the recording head based on the temperature detected by the temperature detector.

According to the recording apparatus described above, it is possible to accurately detect the heating states of the driving coils or various circuits generated when the driving coils are electrically conducted, with a small number of temperature detectors.

The present disclosure relates to the subject matter contained in Japanese patent application No 2006-124643 filed on Apr. 28, 2006, which is expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

An exemplary embodiment of a dot impact printer (hereinafter simply referred to as a 'printer') to which the invention is applied will be described in detail with reference to the accompanying drawings.

Figure 1:
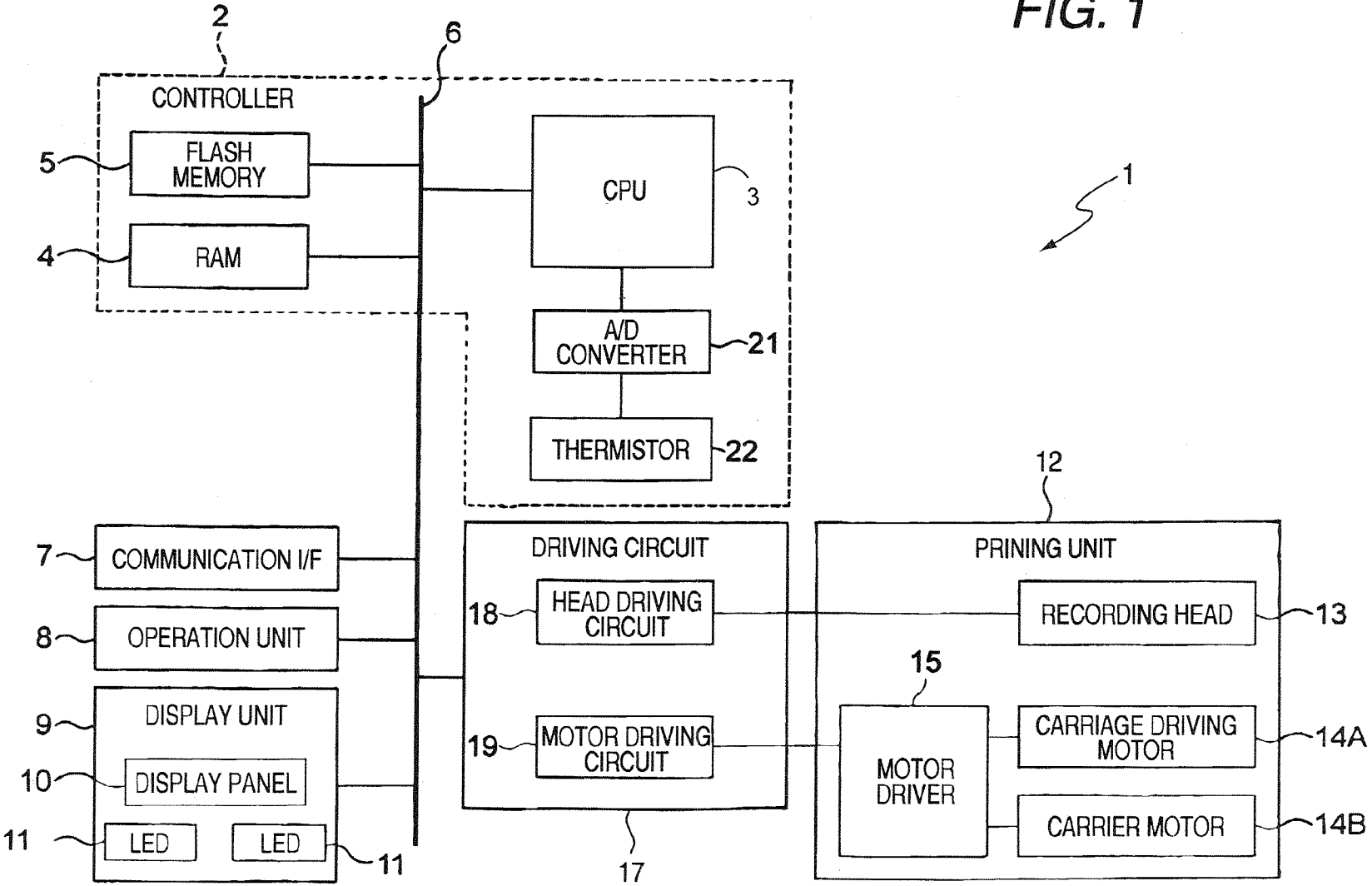
FIG. 1 is a block diagram schematically illustrating the electrical configuration of a printer according to an exemplary embodiment of the invention.

FIG. 1 is a block diagram schematically illustrating the electrical configuration of a printer 1. A controller 2 makes an overall control on respective parts of the printer 1. The controller 2 includes a CPU 3, a RAM 4, and a flash memory 5, which are connected by a bus line 6 with one another. The RAM 4 serves as a work area of the CPU 3 and temporarily stores an operation result or data. The flash memory 5 is a rewritable memory that stores programs, such as firmware executed by the CPU 3, or various kinds of data such as a set value. The firmware includes a real-time OS and, in order to perform various kinds of processes in real time, has functions of estimating a necessary processing time and completing a plurality of processes within a predetermined time even when a plurality of processing requests occur simultaneously.

A communication interface 7 enables wireless or wired data communication with other electronic apparatuses. The communication interface 7 is connected to the controller 2 through the bus line 6. Under the control of the controller 6, the communication interface 7 receives print data from another electronic apparatus and transmits the status of the printer 1, such as a print result or an operation condition, to the electronic apparatus.

An operation unit 8 serves to output a user's instruction to the controller 2 through the bus line 6 and has a plurality of operation elements, such as operation buttons. It is possible to change the operation mode of the printer 1 or effect various settings by operating the operation unit 8. A display unit 9 displays various kinds of information under the control of the controller 2. The display unit 9 includes a display panel 10, which displays print conditions or error messages thereon, and a plurality of LEDs 11 (two LEDs 11 in FIG. 1), which indicate the condition of the printer 1. The operation unit 8 and the display unit 9 are provided on, for example, a front side of the printer 1.

A printing unit 12 executes printing on a recording paper. The printing unit 12 includes a recording head 13, a carriage driving motor 14A, a carrier motor 14B, and a motor driver 15. The recording head 13 is mounted on a carriage. The carrier motor 14B drives a carrier which carries the recording paper. The motor driver 15 outputs a motor driving current to the carriage driving motor 14A and the carrier motor 14B so as to drive the carriage driving motor 14A and the carrier motor 14B.

The recording head 13 is a serial impact dot matrix (SIDM) print head. The recording head 13 includes a plurality of cores 33 and a plurality of recording wires 39, which will be described later. The core 33 is wound with a coil 32 serving as a driving coil. The recording wire 39 is projected to operate by a pulse with a predetermined pulse width which is applied to the coil 32. The printer 1 prints texts or images on the recording paper by causing the recording wires 39 to operate in a projection manner.

A driving circuit 17 is connected to the bus line 6 so as to be able to perform data communication with the controller 2 and generates a driving signal to drive the printing unit 12 under the control of the controller 2. The driving circuit 17 includes a head driving circuit 18 and a motor driving circuit 19. The head driving circuit 18 generates and outputs a head driving current for driving the recording head 13. The motor driving circuit 19 outputs a control signal to the motor driver 15 to generate a motor driving current. The head driving circuit 18 and the motor driving circuit 19 operate based on control data from the controller 2.

The controller 2 includes a thermistor 22 serving as a temperature detector and is connected to the CPU 3 through an A/D converter 21. The thermistor 22 is provided near the head driving circuit 18. The CPU 3 acquires a resistance value of the thermistor 22, which varies depending on temperature, as digital data through the A/D converter 21, and detects the temperature of the head driving circuit 18 based on the data. When the CPU 3 detects that the head driving circuit 18 exceeds a predetermined temperature, the CPU 3 executes a protection control, which will be described later.

Figure 2:
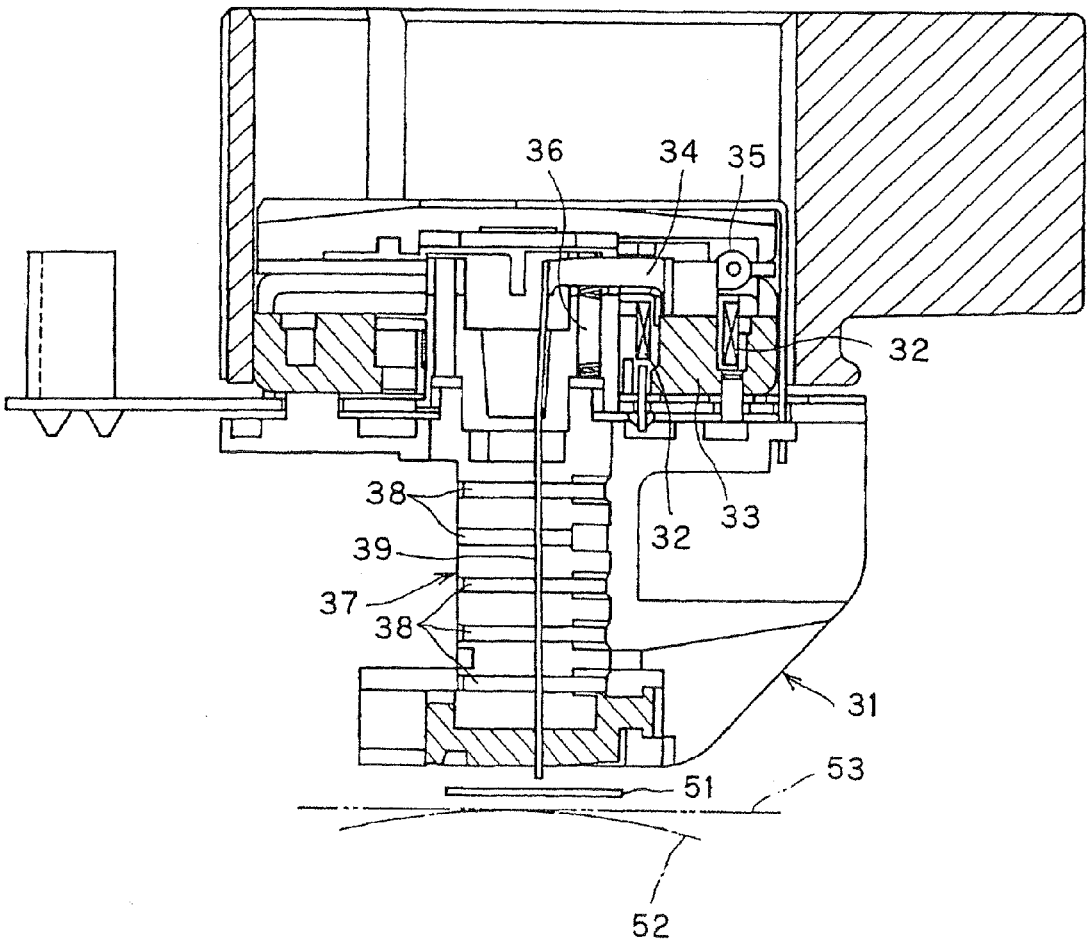
FIG. 2 is a cross-sectional view illustrating the configuration of a recording head.

FIG. 2 is a cross-sectional view illustrating the configuration of the recording head 13. The recording head 13 includes a plurality of cores 33 wound with coils 32 and a plurality of wire levers 34 disposed within a case 31, each of the plurality of cores 33 and each of the plurality of wire levers 34 forming a pair. The wire lever 34 is rotatably fixed to a pin 35 at one end thereof, and is fixed to the recording wire 39 at the other end. The recording wires 39 (twelve recording wires in the present embodiment) are arranged in a row or plurality of rows in a sub-scanning direction.

The wire lever 34 is biased in the direction apart from the core 33 by a spring 36 (clockwise with respect to the pin 35 in FIG. 2). When a driving current does not flow to the coil 32, the wire lever 34 is apart from the core 33 due to a biased force of the spring 36 and the recording wire 39 is received in a nose 37.

A driving current is supplied from the head driving circuit 18 to a plurality of coils 32. When the driving current flows through the coils 32, the core 33 is magnetized such that the wire lever 34 is attracted to the core 33 and rotates the lever 34 around the pin 35. Accordingly, a front end of the recording wire 39 is projected out of the nose 37, and an ink ribbon 51 touches a recording medium 53, such that an ink is transferred. The projection force of the recording wire 39 is applied to a platen 52 opposite thereto with the recording medium 53 interposed therebetween. When the driving current to the coil 32 stops, the core 33 is no longer magnetized, such that the wire lever 34 is apart from the core 33 due to the biased force of the spring 36, and the recording wire 39 is received in the nose 37. At this time, since the wire lever 34 is in an oscillating state, a buffer formed of, for example, fluoride rubber may be provided to absorb the oscillation of the wire lever 34 so that the wire lever 34 can be placed at a predetermined position in a short period of time.

In addition, guides 38 are provided within the nose 37. Each of the guides 38 is formed with a guide hole that serves to guide each of the recording wires 39 to the recording medium 53. The case 31 has heat dissipation fins used to quickly dissipate heat generated from the coil 32.

Figure 3:
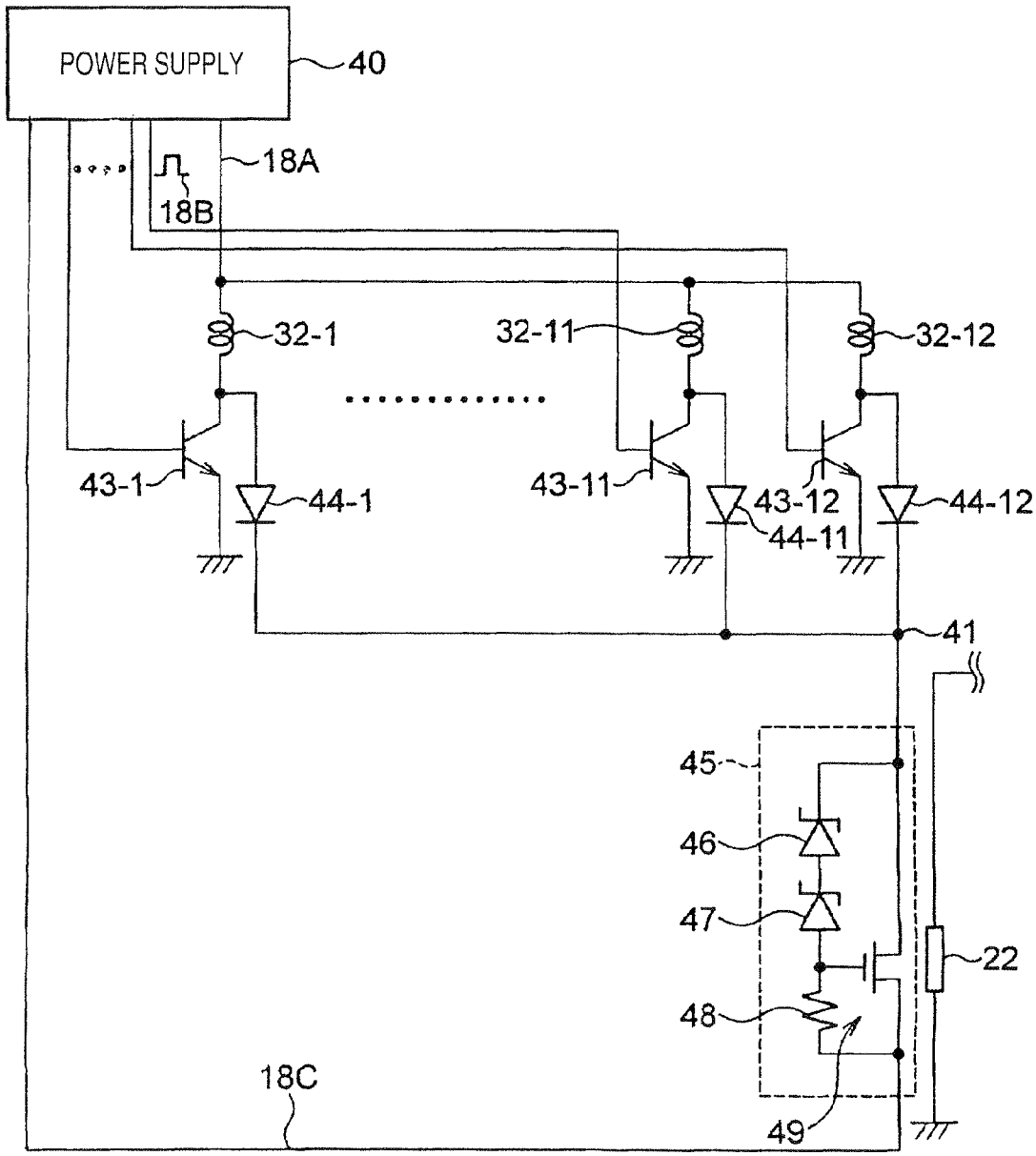
FIG. 3 is a view schematically illustrating the configuration of a head driving circuit used to drive a recording head.

FIG. 3 is a view schematically illustrating the configuration of the head driving circuit 18 used to drive the recording head 13. For the convenience of understanding, FIG. 3 illustrates the coils 32 of the recording head 13 connected to the head driving circuit 18 and the thermistor 22 provided near the head driving circuit 18.

The head driving circuit 18 includes transistors 43 (43-1 to 43-12) and a power supply 40. The transistors 43 (43-1 to 43-12) are connected to twelve coils 32 (32-1 to 32-12), respectively, and serve as switches that switch ON/OFF supply of the driving current to the coils 32. The power supply 40 supplies the driving current to the coils 32 and supplies a control pulse 18B to each of the transistors 43.

The coil 32-*n* (where 'n' is a natural number from 1 to 12) has an end connected to a driving current line 18A and the other end connected to a collector of the transistor 43-*n*, and the driving current is supplied from the power supply 40 through the driving current line 18A. A control pulse 18B is input from the power supply 40 to a base of the transistor 43-*n*. An emitter of the transistor 43-*n* is grounded.

In the configuration described above, when the power supply 40 outputs the control pulse 18B to the transistor 43-*n* under the control of the CPU 3, the transistor 43-*n* is turned ON to cause the driving current to flow through the coil 32-*n*, thereby projecting the recording wire 39 that is provided corresponding to the coil 32-*n*.

In addition, the other end of the coil 32-*n* is connected to an anode of a diode 44-*n* together with the collector of the transistor 43-*n*. A cathode of the diode 44-*n* is commonly connected to a node 41. A circuit that is connected to the power supply 40 with a constant voltage dropping circuit (constant voltage circuit) 45 interposed therebetween is connected to the node 41. A circuit formed from the diode 44-*n* to the power supply 40 is referred to as a circulation circuit 18C through which an induced current flows.

The constant voltage dropping circuit 45 includes two series-connected zener diodes 46 and 47, a resistor 48, and a MOSFET (metal oxide semiconductor field effect transistor) 49. The MOSFET 49 has a gate connected to an anode of the zener diode 47, a source connected to the node 41, and a drain connected to the power supply 40. An end of the resistor 48 is connected to the anode of the zener diode 47, and the other end thereof is connected to the power supply 40 together with the drain of the MOSFET 49.

The constant voltage dropping circuit 45 causes a current, which flows from the diode 44 to the node 41, to be circulated to the power supply 40 after dropping the voltage so as to be adjusted to the voltage of the driving current line 18A.

For instance, when the transistor 43-*n* is turned ON and is then turned OFF according to the control pulse 18B from the power supply 40, an induced current is generated on the coil 32-*n*. The induced current flows through the diode 44-*n* and the node 41 to the constant voltage dropping circuit 45. In this case, when an input voltage of the constant voltage dropping circuit 45 exceeds the zener voltage of the zener diodes 46 and 47, the MOSFET 49 is turned ON. Accordingly, electric power is fed from the constant voltage dropping circuit 45 back to the power supply 40.

In a preferred exemplary embodiment, the zener voltage of the zener diodes 46 and 47 is 55V, and the voltage of the driving current line 18A is 35V. In this case, when the constant voltage dropping circuit 45 has an input voltage of 90V or more, a current flows to the constant voltage dropping circuit 45, and the electric power corresponding to 35V that has voltage-dropped by the zener diodes 46 and 47 is supplied to the power supply 40, thereby preventing an excessive voltage from being applied to the collector of the transistor 43. Furthermore, the induced current is stopped by the zener diodes 46 and 47 at a predetermined voltage or less, thereby making a fast response of the coil 32 at the next conduction time.

The power supply 40 is charged with the power fed back thereto from the circulation circuit 18C. Since the charged power is used in supplying the driving current, the power consumption can be reduced in the head driving circuit 18 to thereby save power.

In addition, the thermistor 22 is provided near the MOSFET 49 that is provided in the constant voltage dropping circuit 45.

Figure 4:
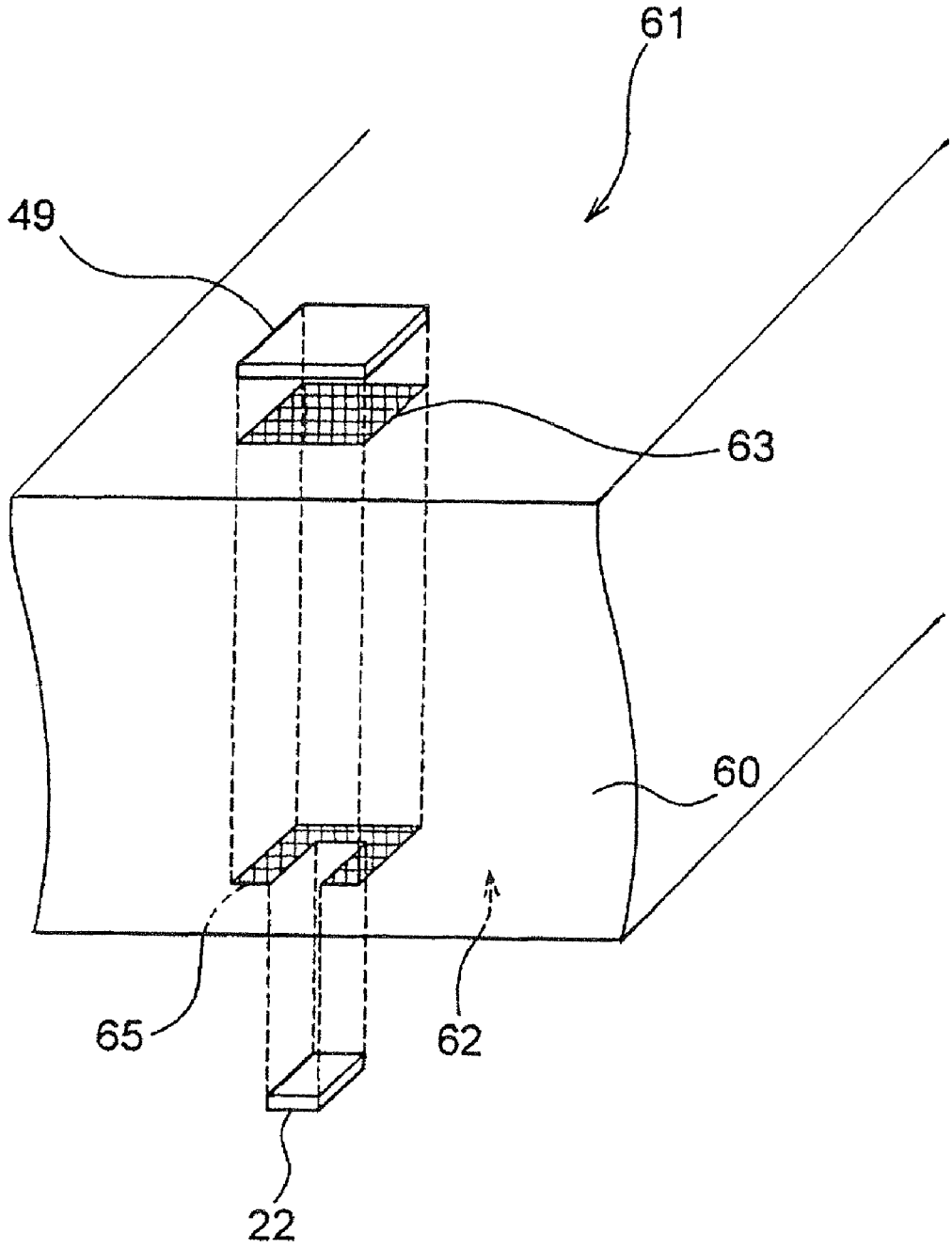
FIG. 4 is an exploded perspective view illustrating main parts in a mounting example of a thermistor.
Figure 5:
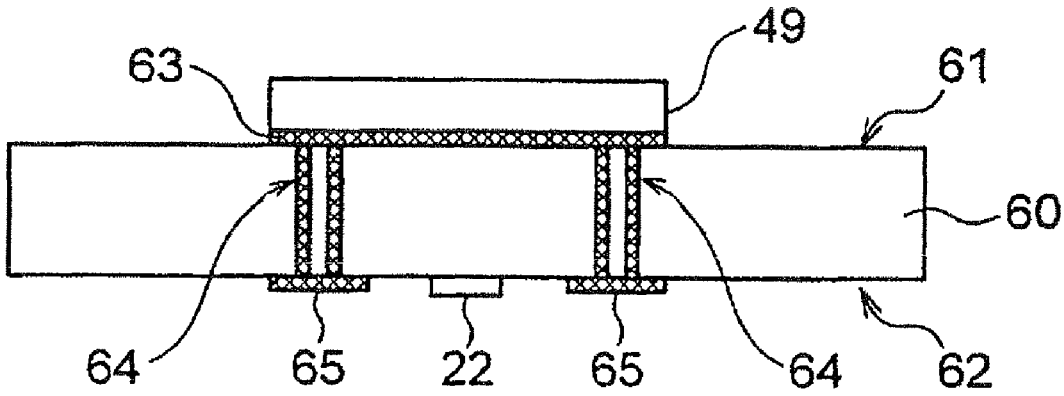
FIG. 5 is a cross-sectional view illustrating main parts in a mounting example of a thermistor.

FIG. 4 is an exploded perspective view illustrating main parts in a mounting example of the thermistor 22, and FIG. 5 is a cross-sectional view illustrating the main parts. The substrate 60 is formed separately from the recording head 13 and is provided, for example, below the printer 1. The substrate 60 is double-sided having A and B surfaces 61 and 62 on which a wiring pattern made of copper foil is formed. The controller 2, the communication interface 7, the operation unit 8, the driving circuit 17, and the A/D converter 21 are mounted on the substrate 60.

The MOSFET 49 is mounted on the A surface 61 of the substrate 60, and a heat dissipation pattern 63 is formed immediately below the MOSFET 49. The heat dissipation pattern 63 is formed to dissipate the heat of the MOSFET 49. It is preferable that the heat dissipation pattern 63 is as wide as possible without breaking insulation between the terminals of the MOSFET 49 and other elements.

Corresponding to the position at which the MOSFET 49 is mounted, a heat dissipation pattern 65 is provided on the B surface 62 of the substrate 60. The heat dissipation pattern 65 is formed at a position overlapping the MOSFET 49 and the heat dissipation pattern 63, in order to rapidly dissipate the heat generated from the MOSFET 49 together with the heat dissipation pattern 63.

As shown in FIG. 5, the heat dissipation pattern 63 formed on the A surface 61 and the heat dissipation pattern 65 formed on the B surface 62 are connected to each other by a through hole 64 passing through the substrate 60. The heat conduction is performed through a conductor on an inner circumference of the through hole 64. Thus, the heat conduction of the MOSFET 49 is performed from the heat dissipation pattern 63 to the heat dissipation pattern 65 through the through hole 64. In order to improve the heat conductivity (heat dissipation efficiency), it is preferable to form many of the through holes 64 that connect the heat dissipation patterns 63 and 65 to each other.

Further, the thermistor 22 is provided on the B surface 62 so as to overlap the heat dissipation pattern 63. The thermistor 22 is fixed to the B surface 62 to detect the temperature of the heat dissipation patterns 63 and 65. In an example shown in FIG. 4, the heat dissipation pattern 65 is formed in a U-shaped plane, and the thermistor 22 is provided inside the U-shaped plane.

In this case, it is preferable to apply a material with high heat conductivity, such as silicon, between the substrate 60 and the MOSFET 49 and between the substrate 60 and the thermistor 22.

In the configuration described above, since the heat of the heat dissipation patterns 63 and 65 is transmitted to the thermistor 22, it is possible to indirectly detect the temperature of the MOSFET 49 through the thermistor 22.

In this case, the heat dissipation pattern 63 may be in contact with the heat dissipation fins of the MOSFET 49 or outer parts of the zener diodes 46 and 47.

The CPU 3 acquires resistances of the thermistor 22 as digital data through the A/D converter 21, thereby detecting the temperature of the MOSFET 49 based on the data. In this case, if the temperature exceeds a predetermined temperature, the CPU 3 performs a protection control.

The RAM 4 or flash memory 5 stores information indicating characteristics related to the MOSFET 49 (for example, the amount of heat emission based on conduction time or voltage, and operation limit temperature) and an equation for obtaining the temperature of the MOSFET 49 from the resistance of the thermistor 22. The CPU 3 obtains the temperature of the MOSFET 49 based on the resistance of the thermistor 22 that is acquired from the A/D converter 21. The CPU 3 performs a protection control based on the temperature of the MOSFET 49 so that the temperature of each of the elements, such as the MOSFET 49 and the coils 32, cannot reach the operation limit temperature.

The protection control is performed to suppress the coils 32 of the recording head 13 and the MOSFET 49 of the head driving circuit 18 from being heated, so that a stable operation of the printer 1 can be secured.

The protection control is performed in the following two ways.

(1) Conduction Time Control (Pulse Width Control)

If the CPU 3 determines that the temperature detected by the thermistor 22 is higher than a first predetermined temperature, the CPU 3 controls the power supply 40 to reduce the pulse width of the control pulse 18B that is output to the coil 32-*n*. Thus, the conduction time of the coil 32-*n* becomes shortened, which improves a balance between the heat emission of the coil 32-*n* and the heat dissipation from the case 31 or the nose 37 of the recording head 13. As a result, it is possible to prevent the coil 32-*n* from being overheated.

(2) Carriage Speed Control (Pulse Interval Control)

If the CPU 3 determines that the temperature detected by the thermistor 22 is higher than a first predetermined temperature, the CPU 3 controls the head driving circuit 18 to increase the interval between pulses of the control pulses 18B that are output to the coil 32-*n*. At this time, the operation speed of the carriage driving motor 14A is reduced by controlling the motor driving circuit 19, such that the operation speed of the carriage on which the recording head 13 is mounted is reduced. Thus, since the conduction time per unit time of the coil 32-*n* is shortened, the cooling time increases, thereby preventing the coil 32-*n* from being overheated.

Either the conduction time control or the carriage speed control may be performed individually, or the conduction time control and the carriage speed control may be performed in combination thereof.

In addition, if the CPU 3 determines that the temperature detected by the thermistor 22 is higher than an upper limit temperature (third predetermined temperature), the CPU 3 stops the head driving circuit 18. In addition, the CPU 3 stops the motor driving circuit 19. Then, when the temperature decreases up to a second predetermined temperature, the CPU 3 causes respective operations to start again. In the present embodiment, the following temperature relationship is established. That is, the first predetermined temperature≦second predetermined temperature third predetermined temperature≦operation limit temperature.

As apparent from the above description, in the printer 1 according to the present exemplary embodiment of the invention, the head driving circuit 18 includes the constant voltage dropping circuit 45 that supplies electric power to the power supply 40 based on the induced current generated when supplying of the driving current to the coils 32 of the recording head 13 stops. In addition, the thermistor 22 is provided near the constant voltage dropping circuit 45 in order to detect the temperature of the constant voltage dropping circuit 45. When the constant voltage dropping circuit 45 emits the heat that exceeds a predetermined temperature, the CPU 3 performs a protection control to suppress the heat.

That is, the CPU 3 performs the protection control based on the temperature of the MOSFET 49 that accurately reflects the conduction condition of the coils 32. Thus, it is possible to more accurately and effectively cope with the heat generated upon the conduction of the coils 32 by using only a single thermistor 22. Thus, the coils 32 of the recording head 13, the MOSFET 49, and the like will not produce heat exceeding the operation limit temperature in the printer 1, resulting in a stable and reliable operation.

Further, since the CPU 3 detects the temperature of the MOSFET 49 by using the thermistor 22 provided near the MOSFET 49 on the substrate 60 on which the MOSFET 49 is mounted, the CPU 3 can accurately detect the temperature of the MOSFET 49. Since the substrate 60 is provided separately from the recording head 13, it is advantageous in that the cost of the recording head 13 does not increase, and the space of the thermistor 22 is not limited.

Moreover, the embodiment described above is only an exemplary embodiment of the invention. Therefore, various modifications and applications may be made within the scope of the invention. For example, the thermistor 22 may be provided next to the MOSFET 49. Alternatively, a heat sink for heat dissipation may be provided on the MOSFET 49, and the thermistor 22 may be fixed to the heat sink of the MOSFET 49. In addition, the thermistor 22 may be provided near another element that is provided on the circulation circuit 18C and emits heat produced due to the induced current flowing on the coils 32. For example, a resistor may be provided between the node 41 and the power supply 40, and the thermistor 22 may be provided near the resistor. In addition, the MOSFET 49 may be mounted on a substrate other than the substrate 60 on which the controller 2 or other elements are mounted.

Examples of the recording medium 53 used in the printer 1 include a cut sheet and a continuous sheet. The cut sheet and continuous sheet are formed of paper, such as typical paper, copying paper, or paperboard, or a sheet made of synthetic resin. In addition, the sheets may be subjected to coating or infiltration, for example. The cut sheet may be formed of cut paper with a regular size (for example, PC paper or postcard), a book with a plurality of sheets that are bound (for example, bankbook), or a bag-shaped one (for example, envelope). In addition, the continuous sheet may be formed of a continuous sheet, which has sprocket holes on both ends thereof and is folded at predetermined intervals, or a roll paper wound on a roll.

The printer 1 described in the present embodiment may be included in other equipment (for example, a copying machine) without being configured as a single apparatus. In addition, it is to be understood that other detailed configurations described in the above embodiment may be appropriately modified.

What is claimed is:

1. A recording apparatus comprising:

a head driving circuit that has a power supply which supplies a driving current to a plurality of driving coils which respectively drives a plurality of recording wires provided in a recording head, and a circuit which is commonly connected to the driving coils, the circuit through which an induced current flows when the supply of the driving current to the driving coils stops;

a constant voltage circuit that causes the induced current to stop at a predetermined voltage or less;

a thermistor that detects a temperature change which occurs in the circuit due to the induced current;

a controller that controls an operation state of the recording head based on the temperature change detected by the thermistor; and a substrate on which the constant voltage circuit and the thermistor are mounted, wherein the constant voltage circuit is mounted on one surface of the substrate and a first heat dissipation pattern for conducting heat generated from the constant voltage circuit is formed on the one surface of the substrate;

wherein the thermistor is mounted on another surface of the substrate and a second heat dissipation pattern is formed on the another surface of the substrate at a position overlapping the first heat dissipation pattern;

wherein the first heat dissipation pattern and the second heat dissipation pattern are connected to each other by a through hole passing through the substrate;

wherein the thermistor is disposed on the another surface of the substrate opposite the first heat dissipation pattern.

2. The recording apparatus as set forth in claim 1, wherein the heat generated from the constant voltage circuit is conducted from the first heat dissipation pattern to the second heat dissipation pattern through the through hole.

3. The recording apparatus as set forth in claim 1, wherein the controller changes a control pulse width that is output to the driving coils based on a temperature detected by the thermistor.

4. The recording apparatus as set forth in claim 1, wherein the controller controls the head driving circuit to change an interval between control pulses which are output to the driving coils based on a temperature detected by the thermistor.

5. The recording apparatus as set forth in claim 4, further comprising a carriage driving motor that moves a carriage on which the recording head is mounted in a recording direction, wherein an operation speed of the carriage driving motor is reduced to reduce an operation speed of the carriage.

* * * * *